US006185820B1

(12) United States Patent
Foster

(10) Patent No.: US 6,185,820 B1
(45) Date of Patent: Feb. 13, 2001

(54) REDUCED COST SUBSTRATE RETAINING MAT

(75) Inventor: Michael Ralph Foster, Columbiaville, MI (US)

(73) Assignee: General Motors Corporation, Detroit, MI (US)

( * ) Notice: Under 35 U.S.C. 154(b), the term of this patent shall be extended for 0 days.

(21) Appl. No.: 09/178,589

(22) Filed: Oct. 26, 1998

(51) Int. Cl.[7] ..... F01N 3/28; B01J 35/04; B01D 53/94

(52) U.S. Cl. ..... 29/890; 422/179; 428/98

(58) Field of Search ..... 422/171, 177, 422/179, 180; 29/890; 428/913, 920, 921, 98

(56) References Cited

U.S. PATENT DOCUMENTS

| | | | | |
|---|---|---|---|---|
| 3,163,256 | | 12/1964 | Lanning | 422/171 |
| 3,189,418 | | 6/1965 | Gary | 422/176 |
| 4,559,205 | | 12/1985 | Hood | 422/180 |
| 4,663,204 | * | 5/1987 | Langham | 428/913 |
| 4,698,213 | * | 10/1987 | Shimori et al. | 422/179 |
| 4,985,212 | * | 1/1991 | Kawakami et al. | 422/179 |
| 5,187,142 | | 2/1993 | Richmond et al. | 502/428 |
| 5,330,728 | | 7/1994 | Foster | 422/177 |
| 5,681,640 | * | 10/1997 | Kiser | 428/913 |
| 5,693,295 | | 12/1997 | Foster | 422/180 |
| 5,766,559 | | 6/1998 | Blanchet et al. | 422/171 |
| 5,804,147 | | 9/1998 | Blanchet et al. | 422/171 |

FOREIGN PATENT DOCUMENTS

WO 98/45583 * 10/1998 (WO) .

OTHER PUBLICATIONS

U.S. application No. 08/932,713, Filed Sep. 17,1997, Inventor: Foster et al., assigned to the assignee of this invention.
U.S. application No. 08/943,847, Filed Oct. 3, 1997, Inventor: Foster, assigned to the assignee of this invention.
U.S. application No. 09/003,943, Filed Jan. 8, 1998, Inventor: Foster, assigned to the assignee of this invention.
U.S. application No. 09/094,861, Filed Jun. 15, 1998, Inventor: Foster, assigned to the assignee of this invention.
U.S. application No. 09/141,299, Filed Aug. 27, 1998, Inventor: Foster et al., assigned to the assignee of this invention.
U.S. application No. 09/144,481, Filed Aug. 31, 1998, Inventor: Foster et al., assigned to the assignee of this invention.

* cited by examiner

*Primary Examiner*—Hien Tran
(74) *Attorney, Agent, or Firm*—Vincent A. Cichosz

(57) ABSTRACT

A catalytic converter mat having a high density in areas which coincide with the ends of a substrate to be wrapped thereby and low density between the ends is disclosed which reduces cost of the mat component of a catalytic converter while retaining the benefits of proper mat pressure at the inlet and outlet ends of the substrate to retain and support the substrate without mat erosion and insulation of the substrate from the canister.

17 Claims, 2 Drawing Sheets

REDUCED COST SUBSTRATE RETAINING MAT

TECHNICAL FIELD

The present invention relates to producing catalytic converters. More particularly, the invention relates to producing catalytic converters while reducing the cost of the intumescent mat employed.

BACKGROUND OF THE INVENTION

Catalytic converters regularly employ a housing or canister, a catalytic substrate material and an intumescent mat placed between the canister and the substrate to hold the substrate in place and insulate the canister from the heat of the substrate during operation. Many different methods of wrapping the mat around the substrate exist and many different thicknesses and densities of these mats are designed into different catalytic converters.

Typical prior art methods for wrapping the substrate material around the catalytic substrate use a single thickness of mat material. This is true whether a single layer of mat is employed or multiple layers of mat are used. The method works extremely well and is reliable but is expensive to manufacture from the standpoint of material. Because lower housing temperatures are increasingly desirable, thicker intumescent mats are being employed on a regular basis. Additionally, more dense mat is being used to prevent erosion of the edges of the mat while the catalytic converter is in service. With thickness and density comes higher expense. Avoiding expense increase is therefore a desirable interest.

SUMMARY OF THE INVENTION

It is an object of the invention to reduce the cost of mat materials needed to manufacture a catalytic converter.

It is a further object of the invention to produce a catalytic converter having a lower temperature outer housing. It is yet a further object of the invention to accomplish the above objects while retaining mat mounting densities at the inlet and outlet ends of the substrate.

Advantageously, the method for producing catalytic converters and the catalytic converter produced thereby achieve the above objects by providing a single mat and partially cutting and folding the mat upon itself in specific locations to create a structure having variable thickness and therefore discrete densities after being packed into the housing or canister.

BRIEF DESCRIPTION OF THE DRAWINGS

The present invention will now be described, by way of example only, with reference to the accompanying drawings in which.

DETAILED DESCRIPTION OF THE INVENTION

The invention achieves all of the foregoing objects by employing a single weight mat and creating specific areas of mat which when the substrate and mat are mounted in the converter canister, become more dense than areas other than the specific areas. By providing the specific areas where density is higher at the inlet and outlet ends of a catalytic substrate, the substrate can be properly mounted and the area between the inlet and outlet ends can be of less dense material. Thus, the substrate is properly mounted in the canister at the inlet and outlet ends thereof with mount densities created by layered material and which are at densities generally accepted as required for good substrate retention and minimized erosion. The middle area of the mat relative to the substrate provides excellent insulation properties due to the low density, and therefore low thermal conductivity of the material. Because less material is employed in the central area due to the configuration of the invention all design parameters of the catalytic converter are met while reducing cost.

Figure 1:
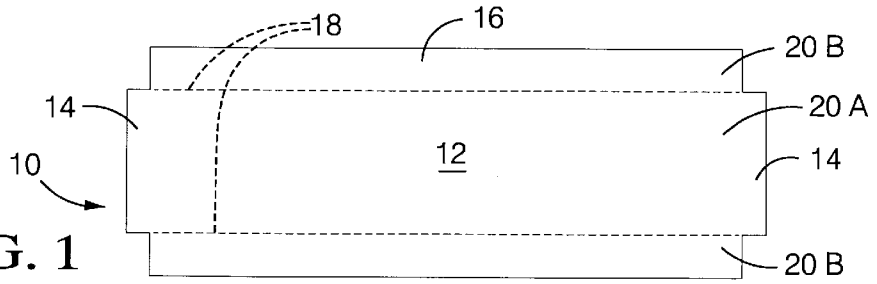
FIG. 1 is a plan view of a mat illustrating lines upon which a fold is taught.

Referring to FIG. 1 a first embodiment of the mat of the invention is illustrated in plan view. Each mat part 10 is cut from large roll of mat with a certain basis weight in grams per square meter. After this mat is cut to the desired shape and installed in a converter assembly, it has a density in grams per cubic centimeter, determined by the basis weight of the mat used, and the annular space in which it is installed. The method of folding the mat is dictated by the ratio of mat density needed at the inlet and outlet ends of the catalyst coated substrate, to the density needed in the central area of the catalyst coated substrate. The embodiment illustrated in FIGS. 1–4 is for a mat that requires a density in the finished product of for example 1.0 grams per cubic centimeter at the inlet and outlet ends of the converter and a density of 0.5 grams per cubic centimeter in the central area of the catalytic converter. One way to achieve this result is to provide mat 10 of FIG. 1 which includes body 12, tongues 14 and wings 16.

Figure 2:
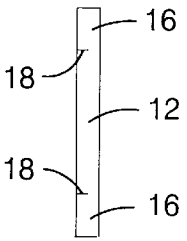
FIG. 2 is an end view of the mat of FIG. 1 and illustrates the partial cuts of the material at the illustrated fold line.

One of ordinary skill in the art will recognize that tongues 14 are provided to span the larger circumferential distance traversed by an outer layer of material in a two or more layered mat when being wrapped around a catalytic substrate. In order to render folding of the wings easier and to ensure that the mat when folded is substantially flat, wings 16 are partially severed from body 12 as illustrated in FIG. 2 and identified by slits 18. The depth of each slit 18 is preferably about one-half the thickness of the mat 10. Without slits 18, it would be very difficult to fold the mat at the proper location.

Figure 3:
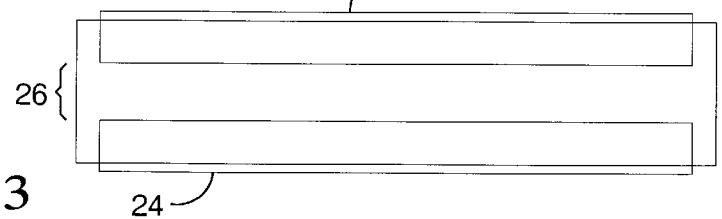
FIG. 3 is a plan view of the mat of FIG. 1 in the folded condition.
Figure 4:
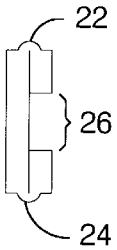
FIG. 4 is an end view of the mat of FIG. 3.
Figure 5:
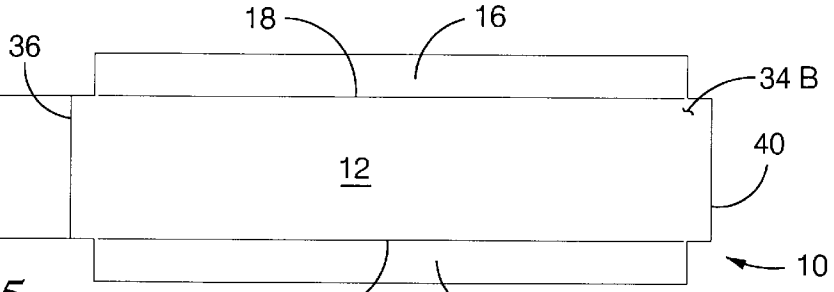
FIG. 5 is a plan view of a mat with an alternate fold pattern of the invention comprising a second embodiment.
Figure 6:
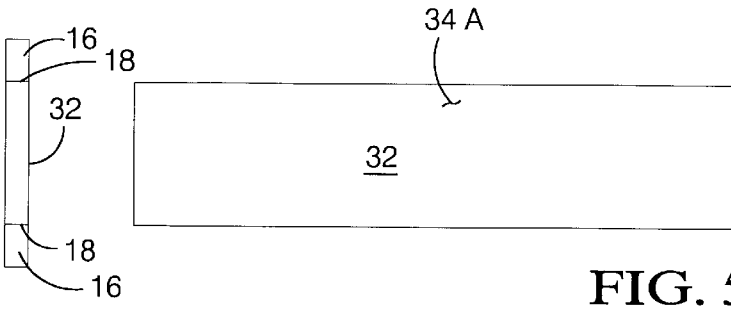
FIG. 6 is an end view of the mat of FIG. 5.
Figure 7:
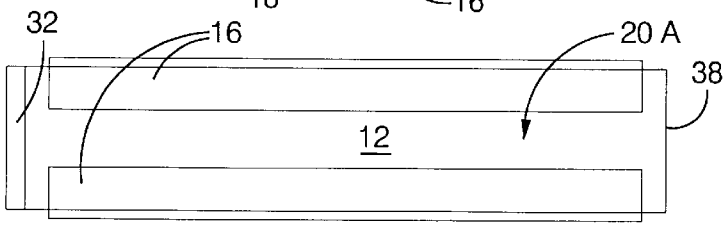
FIG. 7 is a plan view of the folded mat of the second embodiment.

In the invention, folding of mat 10 is easy and non-binding and easily creates a mat of the structure illustrated in FIGS. 3 and 4. Each wing 16 is folded away from slit 18 thus opening the mat material along each slit 18.

Figure 10:
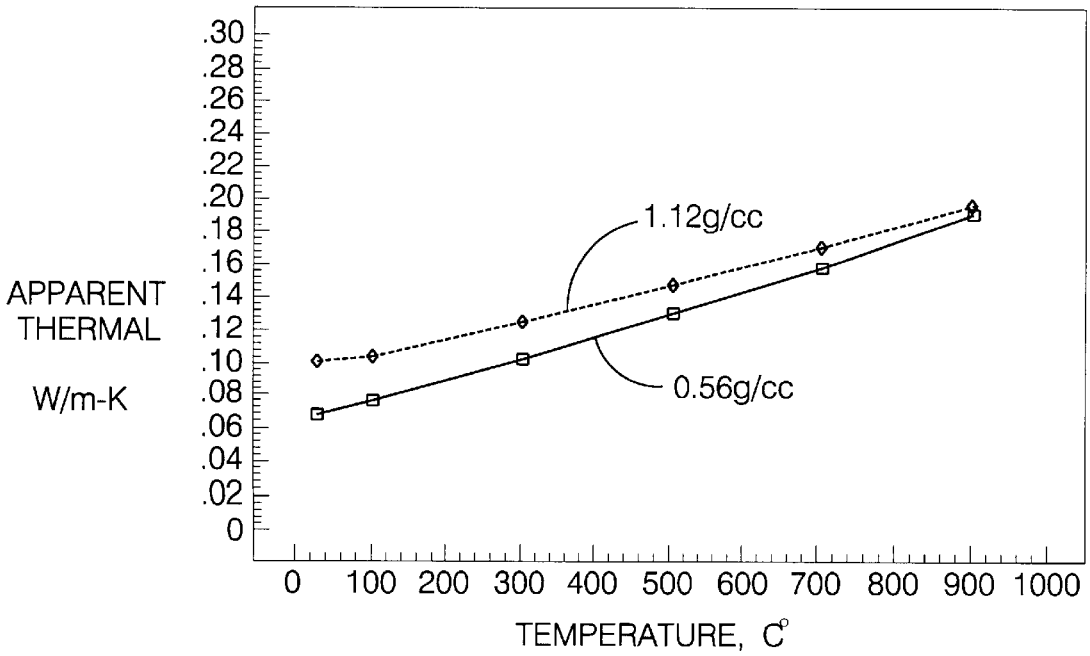
FIG. 10 is a graph representing thermal conductivity of the mat for density versus temperature.

The folding motion is continued in this direction until surface 20*a* of body 12 and each surface 20*b* are in contact with one another. It should be understood that surface 20 has been artificially divided into surfaces 20*a* and 20*b* to illustrate the pattern of folding and in fact constitutes a single surface of mat 10. When surfaces 20*b* are in contact with surface 20*a* (reference to FIG. 4 being made) the inlet and outlet edges 22 and 24 of mat 10 (these are interchangeable) are twice the thickness of the central area indicated as 26. Twice the density is, thus, achieved upon installing the mat 10 into a converter shell with a substrate. The density of edges 22 and 24 is calculated in advance to provide proper support for a catalytic substrate. The density of central section 26 is not as important for mounting purposes and so is calculated to provide sufficient insulating properties. While more insulation generally provides more insulative properties, less insulation can often match the insulative properties of more insulation in a fixed space. This is because higher density insulation is of higher thermal conductivity and less dense material is of reduced thermal conductivity. A graph reflecting thermal conductivity of relative densities is provided in FIG. 10.

Since the material is of lower density at the central section of the substrate, a cost savings is realized while retaining proper mounting pressures at the inlet and outlet ends of the mat by providing local higher density material as described.

In another embodiment of the invention, referring to FIGS. 5–9, another method of folding is illustrated which produces a mat with density in the finished catalytic converter of a central section two thirds as great as at the inlet-outlet ends of the substrate around which the mat is wrapped. One preferred method of folding a mat to produce the desired result is illustrated beginning with FIG. 5.

Initially, the mat material 10 is cut into a shape which facilitates the folding operation and enables proper wrapping of the mat around the substrate of a catalytic converter. The shape, it will be appreciated, should take into account the longer circumferential path of the layers of material that will be positioned more radially outwardly relative to the catalytic substrate. Flap of tongue 32 shall be the longest piece of mat in the layup. In this embodiment, two surfaces must be identified and artificially broken up as they were in the previous embodiment for purposes of clarity. In this embodiment, surface 34 is identified as 34A and 34B and a fold line 36 is shown. Along fold line 36 is slit 38 which extends inwardly into the thickness of mat 10 from a surface on the reverse side of mat 10 from surface 34. For continuity from the discussion of the previous embodiment, the relevant surface is a surface shown generally at 20A. It should be noted that because flap 32 is added in this embodiment surface 20A is larger in this embodiment than in the previous embodiment. The additional section of surface 20A occasioned by flap 32 is identified as surface 20C. Slit 38 begins inwardly into mat 10 from surface 20 at the parting line between surface 20A and 20C. Slit 38 is preferably about one-half the thickness of mat 10. Slits 18 are also provided, as in the previous embodiment, at the line where wings 16 join body 12 and are to the same depth as previously disclosed. Slits 18 extend from surface 34B into the mat 10.

Figure 8:
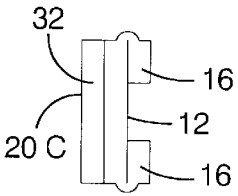
FIG. 8 is a end view of the folded mat of the second embodiment.
Figure 9:
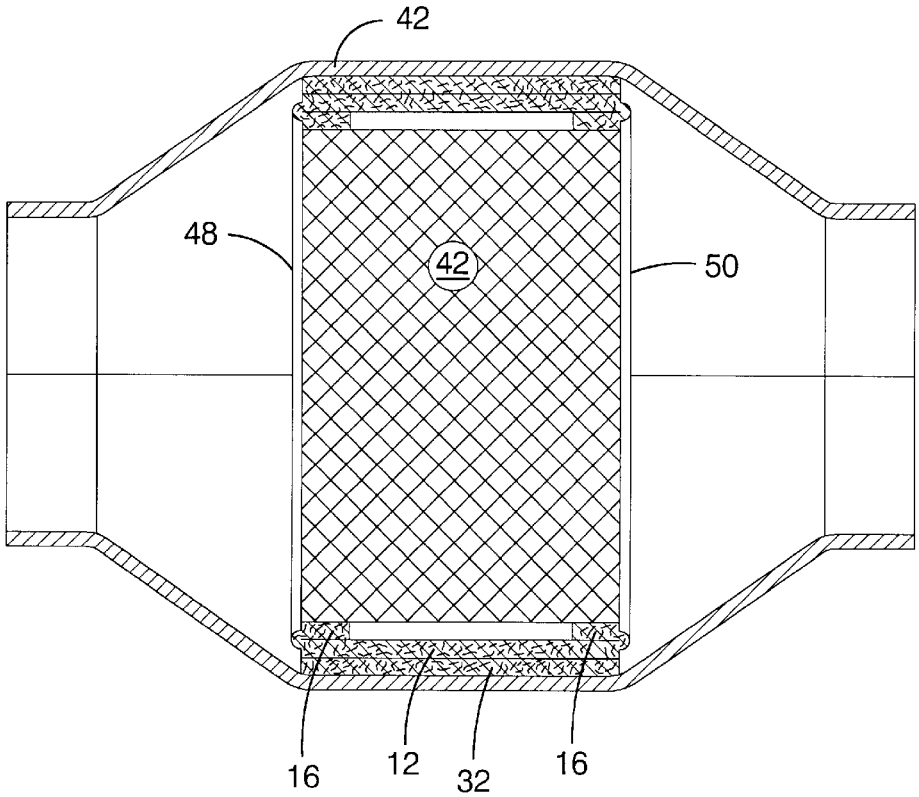
FIG. 9 is a cross-sectional view of a catalytic converter of the invention employing the mat of the FIG. 5 (second) embodiment.

The first fold is carried out along fold line 36 and opens slit 38. From the view of FIG. 5, the folding is of the right half of the drawing onto the left half of the drawing using fold line 36 as the reference line. In this embodiment, preferably flap 32 is longer than body 12 and will extend beyond edge 40 of body 12 when surface 34B is in overlying contact with surface 34A. The extended portion is visible in FIG. 7 as the structure extending beyond edge 40. Wings 16 are folded as they were described in the previous embodiment yielding an end view of the mat as shown in FIG. 8. The folded and wrapped mat 10 is schematically illustrated in a finished product catalytic converter in FIG. 9 wherein catalyst substrate 42 is mounted within housing 44 by mat 10 in folded form. For clarity, the above discussed numerals are employed in FIG. 9 to show the different portions of mat 10. As one of skill in the art should now appreciate, the inlet 48 and outlet 50 ends of the substrate 42 in FIG. 9 are mounted with more density of mat 10 whereas the central area has only two layers of mat and therefore is less dense.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A method of producing a variable density intumescent mat installable into a catalytic converter canister such that areas of said variable density intumescent mat have an increased density disposed proximate an inlet port and an outlet port of said catalytic converter canister, comprising:

cutting an intumescent mat material to a selected shape;

slitting said intumescent mat material in selected locations;

folding said intumescent mat material at said selected locations to create areas of said intumescent mat material having increased thicknesses; and installing said intumescent mat material into said catalytic converter canister such that said areas of said intumescent mat material having said increased thicknesses are compressed to form areas of said intumescent mat material having increased densities.

2. The method of producing a variable density intumescent mat as claimed in claim 1 wherein said cutting includes cutting said intumescent mat material to have a body portion, wing portions, and tongue portions.

3. The method of producing a variable density intumescent mat as claimed in claim 2 wherein said intumescent mat material is slit to form slit lines at points at which said wing portions and said tongue portions are connected to said body portions.

4. The method of producing a variable density intumescent mat as claimed in claim 3 wherein said folding is performed along said slit lines.

5. The method of producing a variable density intumescent mat as claimed in claim 4 wherein said wing portions extend along opposing longer edges of said body portion and wherein said slitting is parallel to said opposing longer edges of said body portion, thereby allowing said wing portions to be folded onto said body portion at said longer opposing edges.

6. The method of producing a variable density intumescent mat as claimed in claim 5 wherein said folding of said wing portions onto said body portion is such that each of said wing portions is folded away from said corresponding slit line and continued until a surface of each of said wing portions are in intimate contact with a surface of said body portion.

7. The method of producing a variable density intumescent mat as claimed in claim 4 wherein said tongue portions protrude from opposing shorter edges of said body portion and adjacent to said wing portions and wherein said slitting is parallel to said opposing shorter edges of said body portion, thereby allowing said tongue portions to be folded onto said body portion at said shorter opposing edges.

8. The method of producing a variable density intumescent mat as claimed in claim 2 wherein at least one of said tongue portions is cut to a length such that said tongue portion is at least as long as said body portion.

9. The method of producing a variable density intumescent mat as claimed in claim 8 wherein said folding of said tongue portion is such that said tongue portion is folded away from said slit and brought into overlying contact with a surface of said body portion.

10. The method of producing a variable density intumescent mat as claimed in claim 4 wherein said slitting of said intumescent mat material is to a depth of about one-half the thickness of said intumescent mat material.

11. The method of producing a variable density intumescent mat as claimed in claim 1 wherein said installing includes inserting said areas of intumescent mat material having said increased thickness into spaces proximate said inlet ports and said outlet ports to create areas of increased density.

12. The method of producing a variable density intumescent mat as claimed in claim 1 wherein said folding of said intumescent mat material is performed such that a catalyst substrate is enclosed within said intumescent mat material.

13. The method of producing a variable density intumescent mat as claimed in claim 12 wherein a plurality of intumescent mats are used to enclose said catalyst substrate.

14. A method of making a catalytic converter, comprising:

forming an intumescent mat;

wrapping a substrate in said intumescent mat, said substrate having a catalyst disposed thereon; and installing said substrate and said intumescent mat into a canister such that said intumescent mat is retained in said canister and has areas of increased density at inlet ports and outlet ports of said canister.

15. The method of making a catalytic converter of claim 14 wherein said forming of said intumescent mat further comprises:

cutting said intumescent mat from a bulk supply of mat material having a certain basis weight;

cutting said intumescent mat to have a specified shape; and slitting said intumescent mat to facilitate folding thereof.

16. The method of making a catalytic converter of claim 15 wherein said wrapping said substrate in said intumescent mat further comprises:

folding sections of said mat away from slit lines made by said slitting operation such that a face of said intumescent mat contacts said face of said intumescent mat; and placing said substrate into a center portion of said folded intumescent mat.

17. The method of making a catalytic converter of claim 16 wherein said installing said substrate and said intumescent mat into said canister further comprises placing said substrate and said intumescent mat into said canister such that folded sections of said intumescent mat form areas of higher density than non-folded sections of said intumescent mat proximate inlet and outlet ports of said canister.

* * * * *